US007314389B1

(12) United States Patent
Yu et al.

(10) Patent No.: US 7,314,389 B1
(45) Date of Patent: Jan. 1, 2008

(54) ELECTRONIC CARD CONNECTOR

(75) Inventors: An-Yu Yu, Keelung (TW); Leland Wang, Walnut, CA (US)

(73) Assignee: Northstar Systems Corp., Taipei (TW)

( * ) Notice: Subject to any disclaimer, the term of this patent is extended or adjusted under 35 U.S.C. 154(b) by 0 days.

(21) Appl. No.: 11/671,492

(22) Filed: Feb. 6, 2007

(51) Int. Cl.
*H01R 24/00* (2006.01)

(52) U.S. Cl. ..... 439/630

(58) Field of Classification Search ..... 439/630, 439/159, 946

See application file for complete search history.

(56) References Cited

U.S. PATENT DOCUMENTS

| | | | | |
|---|---|---|---|---|
| 6,776,640 | B2 * | 8/2004 | Nishioka | 439/325 |
| 6,976,880 | B1 * | 12/2005 | Chi-te et al. | 439/630 |
| 7,175,452 | B1 * | 2/2007 | Lin et al. | 439/159 |
| 2005/0101173 | A1 * | 5/2005 | Harasawa | 439/327 |
| 2005/0101174 | A1 * | 5/2005 | Harasawa | 439/327 |
| 2005/0208804 | A1 * | 9/2005 | Kikuchi et al. | 439/159 |
| 2005/0277318 | A1 * | 12/2005 | Tsuji | 439/157 |
| 2005/0282440 | A1 * | 12/2005 | Tseng et al. | 439/630 |
| 2006/0128225 | A1 * | 6/2006 | Matsumoto et al. | 439/630 |
| 2006/0205281 | A1 * | 9/2006 | Kikuchi et al. | 439/630 |
| 2007/0099463 | A1 * | 5/2007 | Wang et al. | 439/159 |
| 2007/0128943 | A1 * | 6/2007 | Tanaka et al. | 439/630 |

* cited by examiner

*Primary Examiner*—Tulsidas C. Patel
*Assistant Examiner*—Vladimit Imas
(74) *Attorney, Agent, or Firm*—Schmeiser, Olsen & Watts

(57) ABSTRACT

The present invention discloses an electronic card connector that includes a protruding member installed at a lateral side inside an insulating body, such that a sliding portion can latch an electronic card. With the protruding member installed at a lateral side inside an insulating body of the electronic card connector, the latch arm of the sliding portion will not be bent and the electronic card can be latched when an electronic card pushes the sliding portion into the electronic card connector. The invention can achieve the purposes of a high durability, a simple structure and a low manufacturing cost for the electronic card connector, since it is not necessary to bend the latch arm of the sliding portion to latch the electronic card when pushing the electronic card into the electronic card connector.

6 Claims, 6 Drawing Sheets

ELECTRONIC CARD CONNECTOR

FIELD OF THE INVENTION

The present invention relates to an electronic card connector, and more particularly to an electronic card connector having a protruding member installed at a lateral side inside an insulating body of the electronic card connector, such that a sliding portion can be latched with an electronic card.

BACKGROUND OF THE INVENTION

As computer technologies advance, electronic cards become a popular data storage medium for various different electronic products including notebook computers, desktop computers, digital cameras, digital camcorders, mobile phones and personal digital assistants. The conventional electronic card is connected to the electronic products through an electronic card connector. In recent years, techniques have been developed to simplify the electronic card connectors' structures; for instance, a sliding portion concurrently has the function of latching the electronic card to reduce the number of components of the electronic card connector. Although, the structure of the electronic card connector can be simplified by decreasing the number of components used within the electronic card connector, but the related structures of the sliding portion and the electronic card connector would still be complicated. As a result, a higher manufacturing cost is incurred.

Therefore, it is an object of the present invention to disclose an electronic card connector having a simple structure with a high durability and a low manufacturing cost. When the sliding portion is pushed by the electronic card into the electronic card connector, the sliding portion would latch the electronic card within the electronic card connector at the same time.

SUMMARY OF THE INVENTION

In view of the foregoing shortcomings, the inventor of the present invention based on years of experience in the related industry to conduct researches and experiments, and finally developed an electronic card connector in accordance with the present invention to achieve the purposes of a high durability, a simple structure and a low manufacturing cost for electronic card connectors.

Therefore, it is a primary objective of the present invention to provide an electronic card connector having a protruding member installed at a lateral side inside an insulating body, so that when an electronic card pushes a sliding portion into the electronic card connector, the sliding portion will latch the electronic card, in order to achieve the purposes of a high durability as well as a simplified structure and a low manufacturing cost for the electronic card connector.

To achieve the foregoing objectives, an electronic card connector of the invention comprises an insulating body, including a first positioning rod installed onto a wall surface inside the insulating body in a card inserting direction of the electronic card connector, and a protruding member installed onto a wall surface inside the insulating body along a lateral side of the card inserting direction; a sliding portion, disposed at the insulating body, and a lateral side of the sliding portion along the card inserting direction sliding against the protruding member, and an opposite lateral side of the sliding portion having a second positioning rod and a latch arm, and a heart-shaped guide groove being disposed between two lateral sides of the sliding portion, and the second positioning rod corresponding to the first positioning rod, and the latch arm and the second positioning rod being disposed back to back with each other, and a pushed portion being disposed between the second positioning rod and the latch arm; a guide rod, with an end pivotally coupled to the insulating body, and another end disposed at the heart-shaped guide groove; a resilient element, with both ends disposed at the first positioning rod and the second positioning rod respectively; and a cover, for covering the insulating body to form a slot; an electronic card can be inserted from the slot into the electronic card connector along the card inserting direction, and a pushing portion of the electronic card pushes the pushed portion, such that a lateral side of the sliding portion slides on the protruding member, and a latch portion of the latch arm latches a notch of the electronic card. The present invention provides the advantages of a high durability, a simplified structure and a low manufacturing cost for the electronic card connector. When the electronic card is engaged with the sliding portion into the electronic card connector, it does not require to bend the latch arm of the sliding portion while latching the electronic card.

The above and other objects, features and advantages of the present invention will become apparent from the following detailed description taken with the accompanying drawing.

DETAILED DESCRIPTION OF THE PREFERRED EMBODIMENTS

To make it easier to understand the objective, innovative features and performance of the present invention, we use a preferred embodiment and the accompanying drawings for a detailed description of the present invention.

Figure 1:
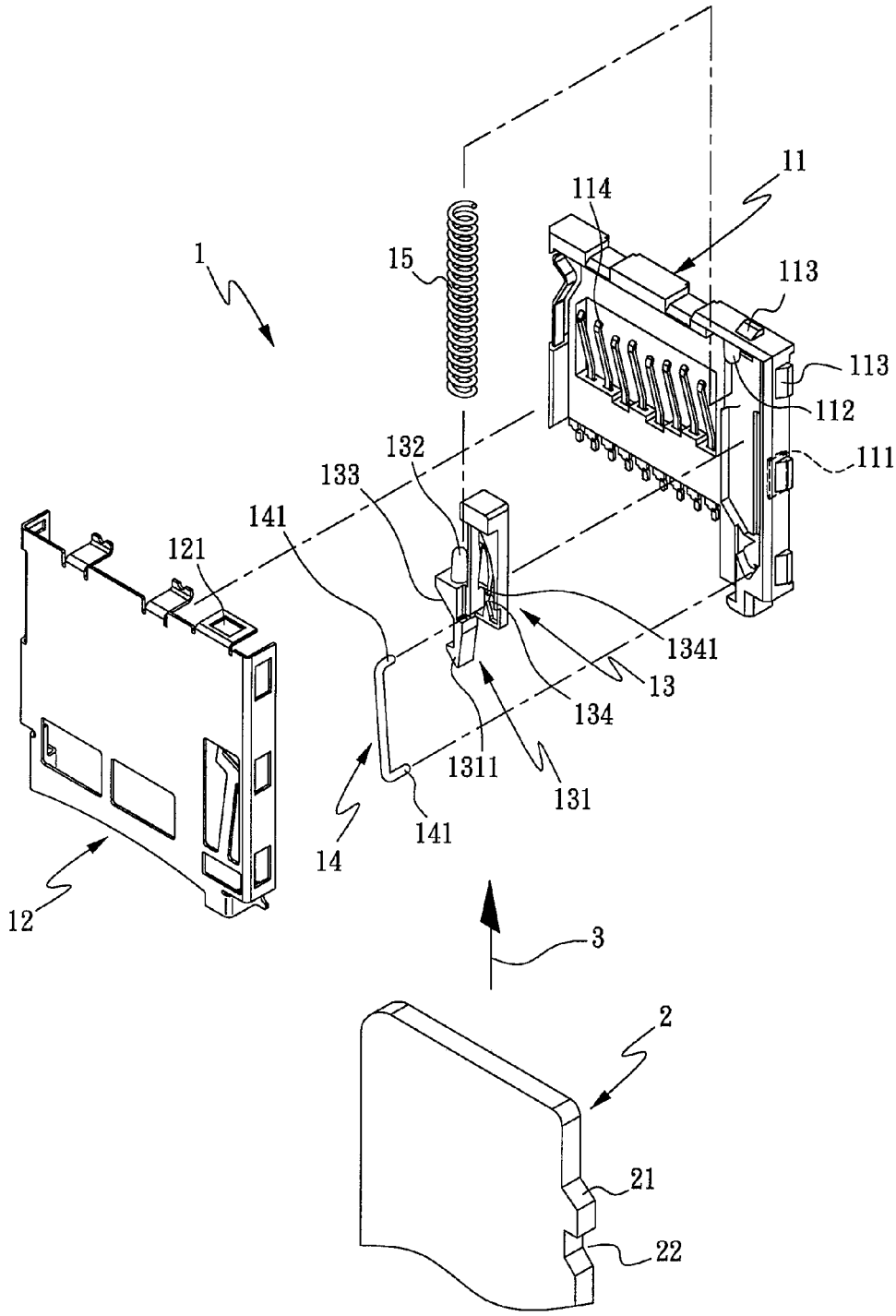
FIG. 1 is an exploded view of a preferred embodiment of the present invention.
Figure 2:
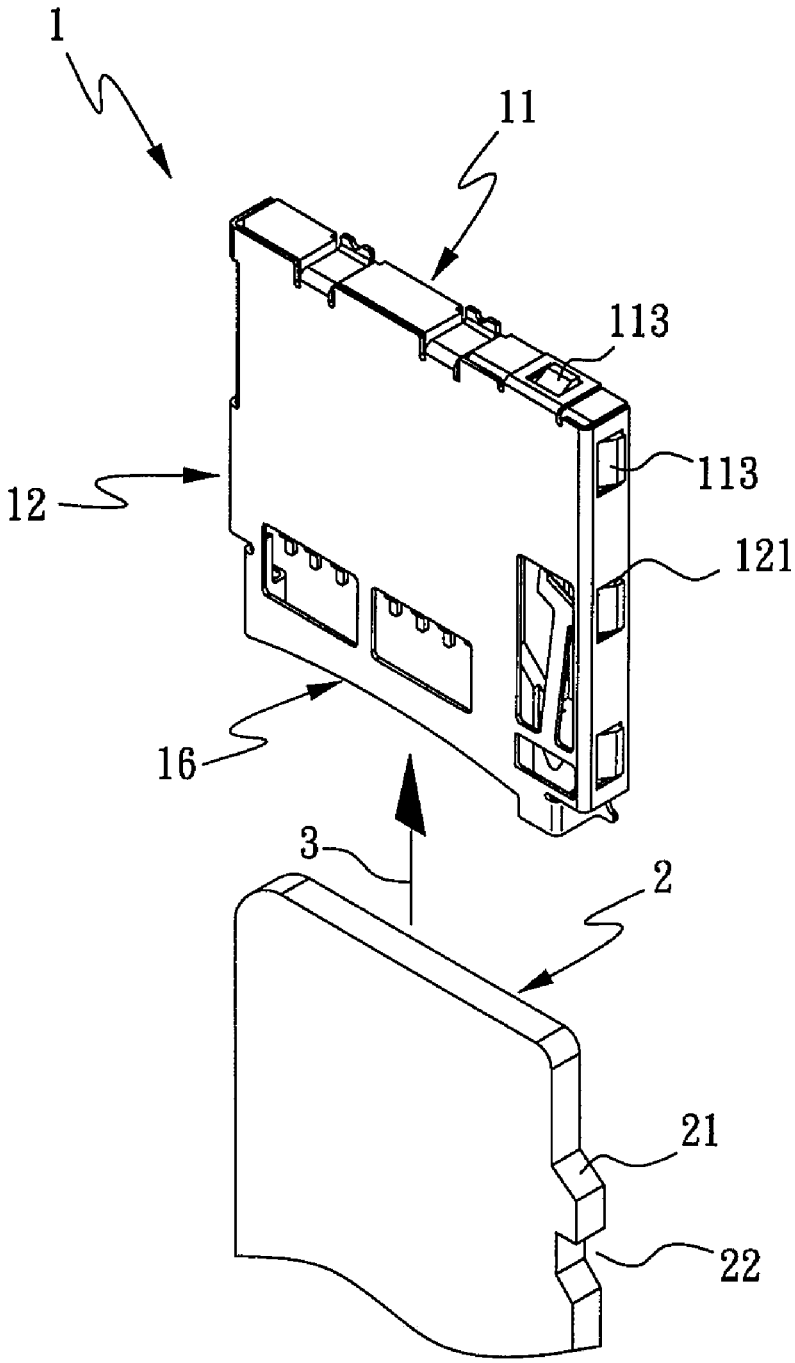
FIG. 2 is a perspective view of a preferred embodiment of the present invention.
Figure 3:
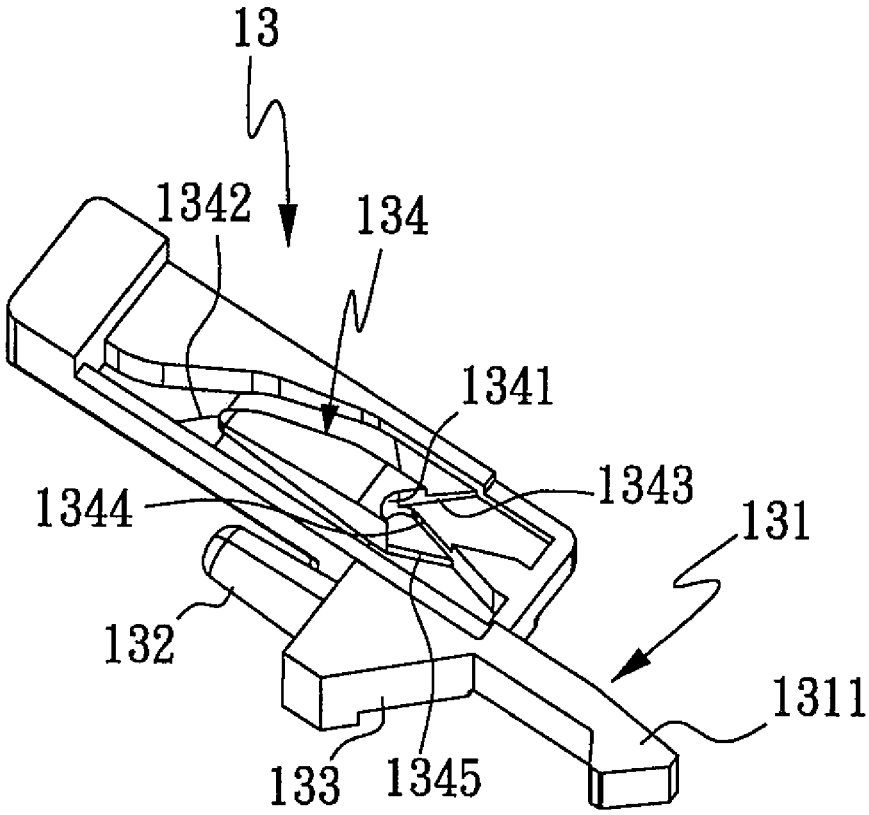
FIG. 3 is a perspective view of a sliding portion of a preferred embodiment of the present invention.
Figure 4:
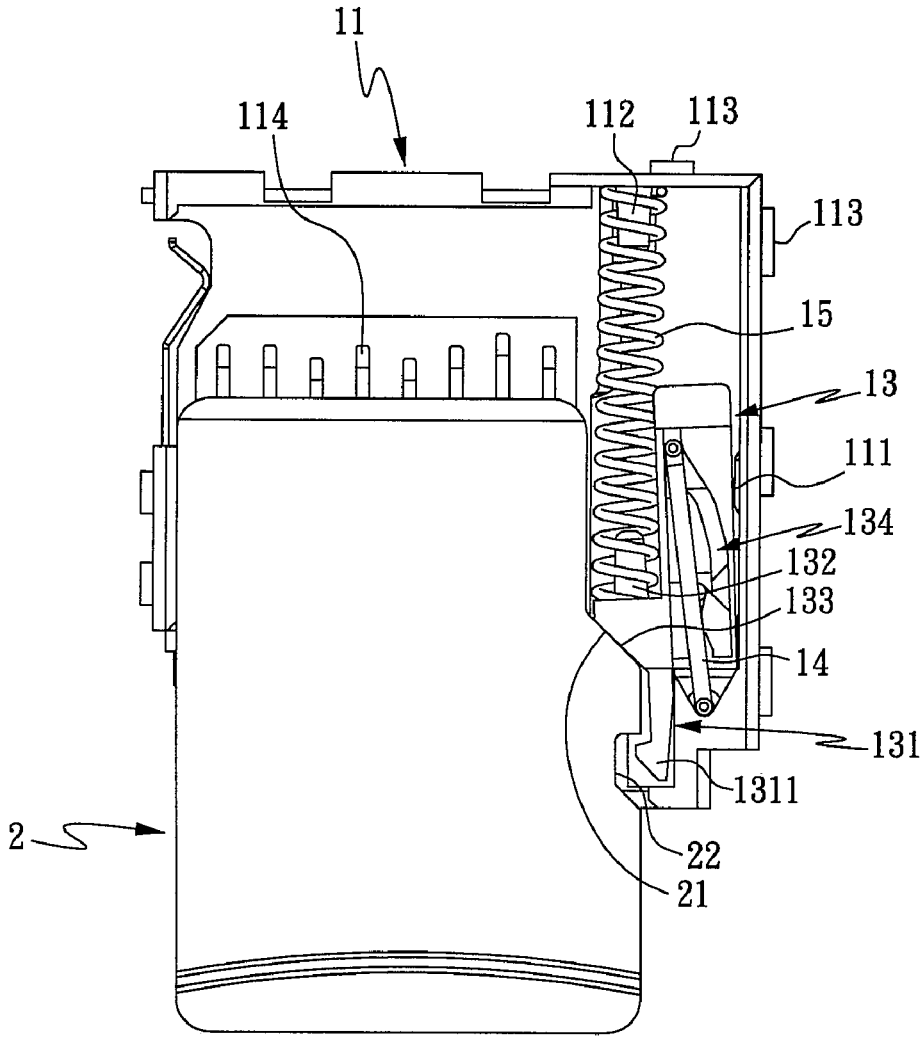
FIG. 4 is a first schematic view of an operation of a preferred embodiment of the present invention.
Figure 5:
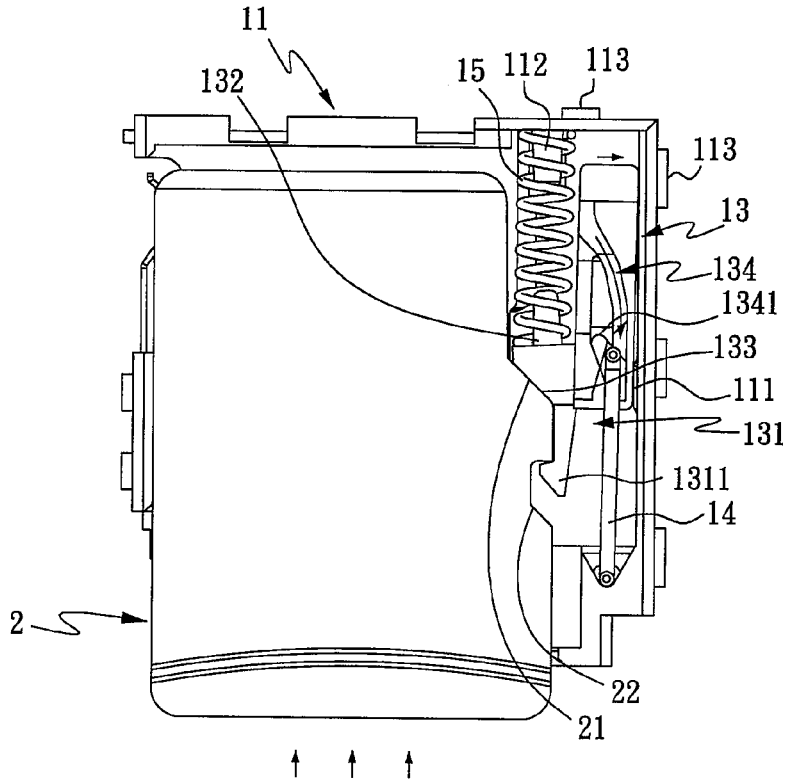
FIG. 5 is a second schematic view of an operation of a preferred embodiment of the present invention.
Figure 6:
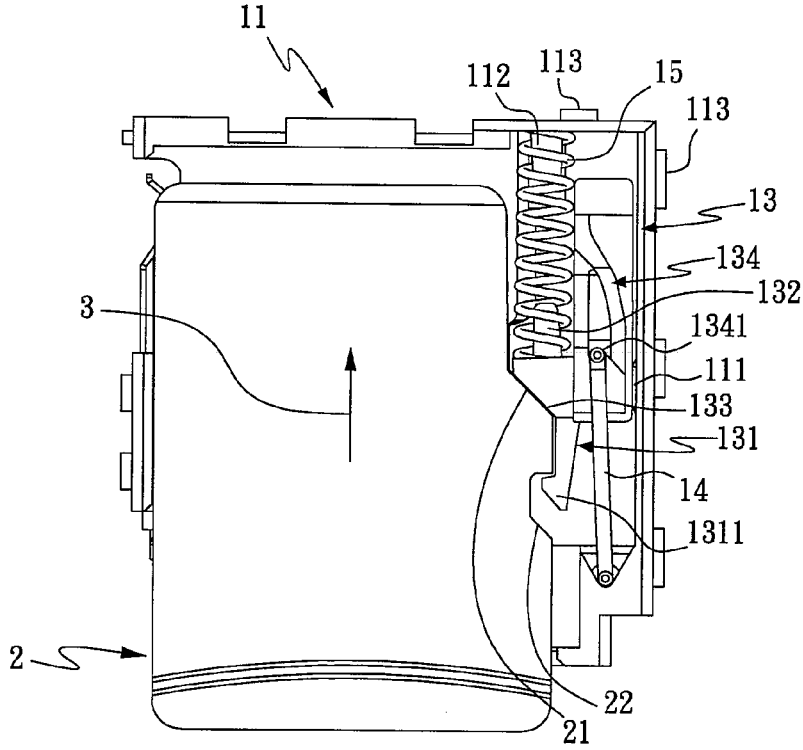
FIG. 6 is a third schematic view of an operation of a preferred embodiment of the present invention.
Figure 7:
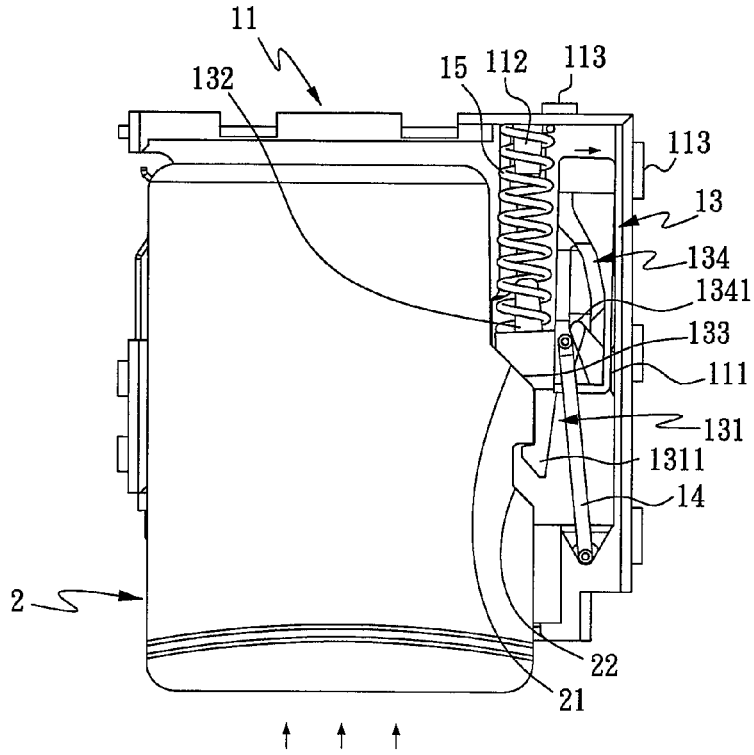
FIG. 7 is a fourth schematic view of an operation of a preferred embodiment of the present invention.
Figure 8:
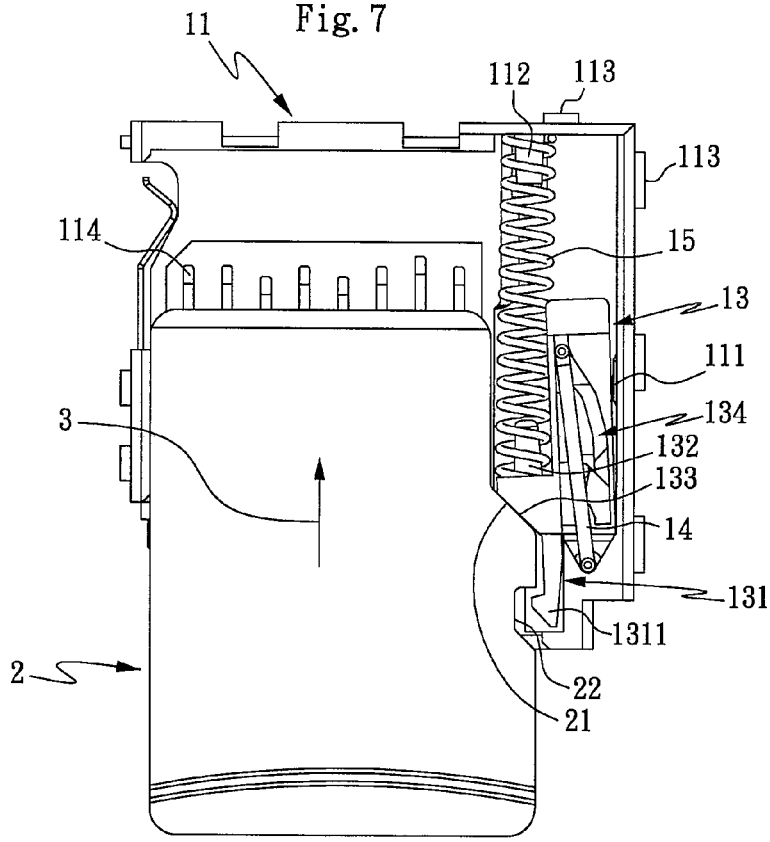
FIG. 8 is a fifth schematic view of an operation of a preferred embodiment of the present invention.

Referring to FIGS. 1 and 2 for an exploded view and a perspective view of a preferred embodiment of the present invention respectively, the electronic card connector 1 comprises an insulating body 11, a cover 12, a sliding portion 13, a guide rod 14 and a resilient element 15, wherein the insulating body 11 includes a protruding member 111, a first positioning rod 112 and a plurality of conducting terminals 114 inside, and the insulating body 11 has a plurality of latch protruding members 113 disposed outside the insulating body 11, and the first positioning rod 112 is installed onto a wall surface inside the insulating body 11 in a card inserting direction 3, wherein the card inserting direction 3 is referred to a direction of an electronic card 2 inserted into the electronic card connector 1. The protruding member 111 is installed onto a wall surface inside the insulating body 11 along the card inserting direction 3, and the conducting terminals 114 are installed in the insulating body 11 and are contacted with the electronic card 2. The cover 12 includes a plurality of latch holes 121, and the latch protruding members 113 of the insulating body 11 are latched with the latch holes 121, so that the cover 12 can be covered and fixed to the insulating body 11 to form a slot 16. The sliding portion 13 is disposed at the insulating body 11, and a lateral side of the sliding portion 13 along the card inserting direction 3 is sliding against the protruding member 111, an opposite lateral side has a second positioning rod 132 and a latch arm 131, and a heart-shaped guide groove 134 is disposed between two lateral sides of the sliding portion 13, and the second positioning rod 132 is corresponsive to the first positioning rod 112, and the latch arm 131 and the second positioning rod 132 are disposed back to back with each other, and a pushed portion 133 is disposed between the second positioning rod 132 and the latch arm 131, and a concave opening 1341 of the heart-shaped guide groove 134 faces towards the slot 16. A guide arm 141 is bent separately from both ends of the guide rod 14, and one of the guide arms 141 is pivotally coupled to the insulating body 11, and another guide arm 141 is disposed in the heart-shaped guide groove 134. A first positioning rod 112 and a second positioning rod 132 are disposed at both ends of the resilient element 15 respectively, and the resilient element 15 can be a spring.

Referring to FIGS. 3 to 8 for a perspective view of a sliding portion and schematic views of the operation of an electronic card connector 1 in accordance with the present invention respectively, an upper section on the right side of the sliding portion 13 leans against the protruding member 111, and the resilience of the spring 15 drives a lower section on the right side of the sliding portion 13 to lean against an internal wall surface of the insulating body 11, and drives the latch portion 1311 of the latch arm 131 to the right side, when the electronic card 2 is inserted into the electronic card connector 1 and just contacted with the sliding portion 13. If the electronic card 2 is pushed all the way to the bottom, the pushing portion 21 of the electronic card 2 will push a pushed portion 133 of the sliding portion 13 to compress the spring 15 and store a resilience, and then the right side of the sliding portion 13 will slide on the protruding member 111 to rotate the sliding portion 13 clockwise, and finally the upper section on the right side of the sliding portion 13 is driven to lean against the internal wall surface of the insulating body 11, and the lower section on the right side of the sliding portion 13 is driven to lean against the protruding member 111, and the latch portion 1311 of the latch arm 131 is shifted to the left and into a notch 22 of the electronic card 2. In the meantime, a guide arm (not shown in the figures) of the guide rod 14 is moved along the first blocking edge 1342 towards the right side of the heart-shaped guide groove 134 to the second blocking edge 1343. If the electronic card 2 is released, the spring 15 releases a portion of the resilience to move the sliding portion 13 and the electronic card 2 in a direction opposite to the card inserting direction 3. In the meantime, a guide arm (not shown in the figures) of the guide rod 14 is moved along the second blocking edge 1343 to the third blocking edge 1344 and placed into a concave opening 1341 of the heart-shaped guide groove 134. With the resilience of the spring 15 and the guide arm (not shown in the figures) of the guide rod 14 pushes the concave opening 1341, the sliding portion 13 is fixed into its position. By limiting the positions between the pushed portion 133 and the latch portion 1311, the electronic card 2 can be fixed in the electronic card connector 1. If it is necessary to remove the electronic card 2, the electronic card 2 is pushed all the way to the bottom, such that the guide arm (not shown in the figures) of the guide rod 14 can be moved between the concave opening 1341 and the third blocking edge 1344 to the fourth blocking edge 1345, and the spring 15 is compressed to store a portion of resilience, and an upper section at the right side of the sliding portion 13 leans against an internal wall surface of the insulating body 11, and a lower section at the right side of the sliding portion 13 leans against the protruding member 111, and then releases the electronic card 2, the spring 15 fully release the stored resilience, such that the sliding portion 13 and the electronic card 2 can be moved in a direction opposite to the card inserting direction 3. A guide arm (not shown in the figures) of the guide rod 14 is moved along the fourth blocking edge 1345 towards the left side of the heart-shaped guide groove 134 to the first blocking edge 1342, and the right side of the sliding portion 13 is moved on the protruding member 111, such that the sliding portion 13 is rotated counterclockwise, and finally the upper section at the right side of the sliding portion 13 leans against the protruding member 111, and the lower section at the right side of the sliding portion 13 leans against an internal wall surface of the insulating body 11. The latch portion 1311 of the latch arm 131 is moved towards the right and out of the notch 22 of the electronic card 2, so that the electronic card 2 can be removed from the electronic card connector 1 conveniently. The electronic card connector 1 of the invention simply requires the installation of a protruding member 111 on the internal wall surface of the insulating body 11, such that when the electronic card 2 pushes the sliding portion 13 into electronic card connector 1, it is not necessary to bend the latch arm 131 of the sliding portion 13, while the latch arm 131 of the sliding portion 13 latches the electronic card 2, and thus the invention can prevent the latch arm 131 of the sliding portion 13 from being elastically deformed or broken, so as to achieve the purposes of a high durability, a simple structure and a low manufacturing cost for the electronic card connector 1.

In summation of the description above, the present invention complies with the requirements of patent application, since the protruding member is installed in the insulating body, such that when the electronic card pushes the sliding portion into the electronic card connector, it is not necessary to bend the latch arm of the sliding portion while latching the electronic card, so as to achieve the purposes of a high durability, a simple structure and a low manufacturing cost for the electronic card connector.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic card connector, comprising:

an insulating body, including a first positioning rod installed onto a wall surface inside the insulating body in a card inserting direction of the electronic card connector, and a protruding member installed onto a wall surface inside the insulating body along a lateral side of the card inserting direction;

a sliding portion, disposed at the insulating body, and a lateral side of the sliding portion along the card inserting direction sliding against the protruding member, and an opposite lateral side of the sliding portion having a second positioning rod and a latch arm, and a heart-shaped guide groove being disposed between two lateral sides of the sliding portion, and the second positioning rod corresponding to the first positioning rod, and the latch arm and the second positioning rod being disposed back to back with each other, and a pushed portion being disposed between the second positioning rod and the latch arm;

a guide rod, with an end pivotally coupled to the insulating body, and another end disposed at the heart-shaped guide groove;

a resilient element, with both ends disposed at the first positioning rod and the second positioning rod respectively; and a cover, for covering the insulating body to form a slot; an electronic card can be inserted from the slot into the electronic card connector along the card inserting direction, and a pushing portion of the electronic card pushes the pushed portion, such that a lateral side of the sliding portion slides on the protruding member, and a latch portion of the latch arm latches a notch of the electronic card.

2. The electronic card connector of claim 1, further comprising a plurality of conducting terminals disposed in the insulating body and contacted with the electronic card.

3. The electronic card connector of claim 1, wherein the insulating body includes a plurality of latch protruding members, and the cover includes a plurality of latch holes, and the latch protruding members can latch the latch holes for covering and fixing the cover onto the insulating body.

4. The electronic card connector of claim 1, wherein a concave opening of the heart-shaped guide groove faces the slot.

5. The electronic card connector of claim 1, further comprising a guide arm separately bent from two ends of the guide rod, and one of the guide arms being pivotally coupled to the insulating body, and another guide arm being installed at the heart-shaped guide groove.

6. The electronic card connector of claim 1, wherein the resilient element is a spring.

* * * * *